US010694876B2

(12) United States Patent
Boyatt

(10) Patent No.: US 10,694,876 B2
(45) Date of Patent: Jun. 30, 2020

(54) CARRY TRAY

(71) Applicant: Natalie Jean Boyatt, Germantown, TN (US)

(72) Inventor: Natalie Jean Boyatt, Germantown, TN (US)

( * ) Notice: Subject to any disclaimer, the term of this patent is extended or adjusted under 35 U.S.C. 154(b) by 0 days.

(21) Appl. No.: 16/161,618

(22) Filed: Oct. 16, 2018

(65) Prior Publication Data

US 2019/0254454 A1 Aug. 22, 2019

Related U.S. Application Data

(63) Continuation-in-part of application No. 14/992,780, filed on Jan. 11, 2016, now Pat. No. 10,098,488.

(60) Provisional application No. 62/233,456, filed on Sep. 28, 2015.

(51) Int. Cl.

| | |
|---|---|
| ***B65D 71/70*** | (2006.01) |
| ***A47G 23/06*** | (2006.01) |
| ***B65D 71/52*** | (2006.01) |

(52) U.S. Cl.

CPC ..... *A47G 23/0641* (2013.01); *A47G 23/0616* (2013.01); *B65D 71/0003* (2013.01)

(58) Field of Classification Search

CPC .... B65D 71/70; B65D 1/243; B65D 71/0003; B65D 25/2858; B08B 9/426

USPC ..... 206/562, 564

See application file for complete search history.

(56) References Cited

U.S. PATENT DOCUMENTS

| | | | | |
|---|---|---|---|---|
| 2,459,921 A * | 1/1949 | Comer | B65D 71/0003 | 220/512 |
| 5,671,846 A * | 9/1997 | Frank | A45C 11/20 | 190/111 |
| 6,527,123 B1 * | 3/2003 | Ausaf | A47J 47/14 | 206/541 |

* cited by examiner

*Primary Examiner* — King M Chu

(74) *Attorney, Agent, or Firm* — Wayne Edward Ramage; Baker Donelson

(57) ABSTRACT

A carry tray a two-part base hingedly attached in the middle along adjacent edges. A removable or detachable handle may be provided. Each base comprises a bottom with a side extending upwards along the circumference, in whole or in part Each part of the base can be polygonal, semi-circular, hemi-circular, rectilinear, curved, or combinations thereof. The tray can be folded up along the hinge into a closed position for convenient storage or transport when not in use. The base may be used with a removable template or foam insert.

11 Claims, 27 Drawing Sheets

CARRY TRAY

This application is a continuation-in-part of U.S. patent application Ser. No. 14/992,780, filed Jan. 11, 2016, which claims benefit of and priority to U.S. Provisional Application No. 62/233,456, filed Sep. 28, 2015, and is entitled to those filing dates for priority. The specifications, figures, and complete disclosures of U.S. Provisional Application No. 62/233,456 and U.S. patent application Ser. No. 14/992,780 are incorporated herein in their entireties by specific reference for all purposes.

FIELD OF INVENTION

This invention relates to a folding, convertible tray for carrying multiple drinks or beverages or other items.

SUMMARY OF INVENTION

In various embodiments, the present invention comprises a carry tray with a removable or detachable handle. The tray comprises a two-part base hingedly attached in the middle along adjacent edges. Each base comprises a bottom with a side extending upwards along the circumference, in whole or in part Each part of the base can be polygonal, semi-circular, hemi-circular, rectilinear, curved, or combinations thereof. The parts of the base can be mirror images of each other, although in other embodiments the two parts may vary. The tray can be folded up along the hinge into a closed position for convenient storage or transport when not in use.

In one exemplary embodiment, one or both of the base parts comprise a plurality of alignment fins or tabs. The alignment fins are arranged or positioned to engage the bottom of a cup or bottle and help secure or hold the cup or bottle in place. The fins may be tapered or rounded, to help receive and guide the bottom of the cup or bottle into place. Any number of fins can be used to engage each cup or bottle. In some embodiments, no alignment fins or tabs need be used, or alternative means to help secure the bottom of each cup or bottle may be used (such as indentations or recessed areas in the base).

One more hole templates also may be used to help secure cups or bottles. Templates may be sized to match the corresponding base part, and may be removably secured thereto (i.e., snap-fit into the base part). Templates comprise one or more holes into which a cup or bottle is inserted. Holes are positioned to align with corresponding sets of alignment fins or tabs. In one embodiment, flexible tabs may extend at an angle inside each hole to engage the sides of the cup or bottle and help hold it upright therein.

The carry tray can thus be used to carry drinks on both sides. Alternatively, a hole template can be removed from one side, thereby allowing the carry tray to be used to carry drinks on one side, and other items (e.g., food, snacks, and the like) on the other side. Both hole templates also may be removed and carry tray used for food, snacks, and the like on both sides.

In another exemplary embodiment, foam inserts may be used in place of hole templates (or as a form of hole template). The foam inserts may be placed into corresponding base parts, and are held in place due to friction or pressure with the sides of the base part, tabs or flanges along the edge of the base part, hook-and-loop fasteners, or combinations thereof. The holes in the foam insert may taper downwards in diameter, and the foam insert may extend for some or all of the depth of the base part, thereby allowing the hole in the foam to securely hold the cup or container placed in the hole. The foam insert may be used without or with alignment fins or tabs, as described above.

The handle can be of any suitable size or configuration. In one embodiment, the handle is molded from ridged material, and comprises a T-shape at each end to engage the base parts and help lock the carry tray together. A contoured or cushioned grip may be located at the top center of the handle. The handle can be rotated to the side for removal or assembly. The carry tray can be used with or without the handle.

DETAILED DESCRIPTION OF EXEMPLARY EMBODIMENTS

Figure 1:
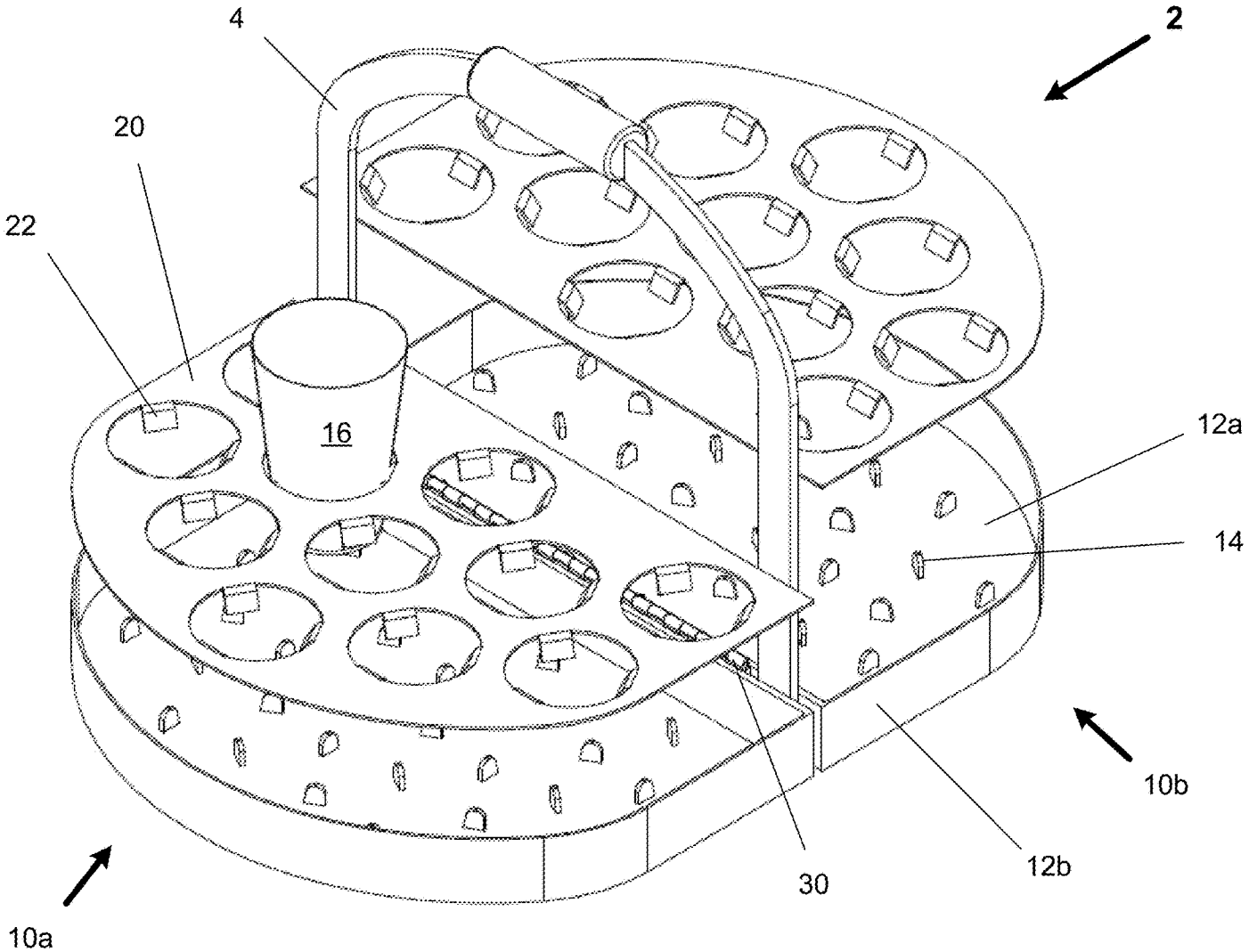
FIG. 1 shows a perspective view of a carry tray and components thereof in accordance with an exemplary embodiment of the present invention.

In various exemplary embodiments, as seen in FIGS. 1-16, the present invention comprises a carry tray 2 with a removable or detachable handle 4. The tray comprises a two-part base 10*a, b* hingedly attached 30 along adjacent edges. Each base comprises a bottom 12*a*, with a side 12*b* extending upwards along the circumference, in whole or in part Each part of the base can be polygonal, semi-circular, hemi-circular, rectilinear, curved, or combinations thereof. As seen in FIG. 1, the parts of the base can be mirror images of each other, although in other embodiments the two parts may vary. As seen in FIG. 4, the tray can be folded up along the hinge 30 into a closed position for convenient storage or transport when not in use.

Figure 2:
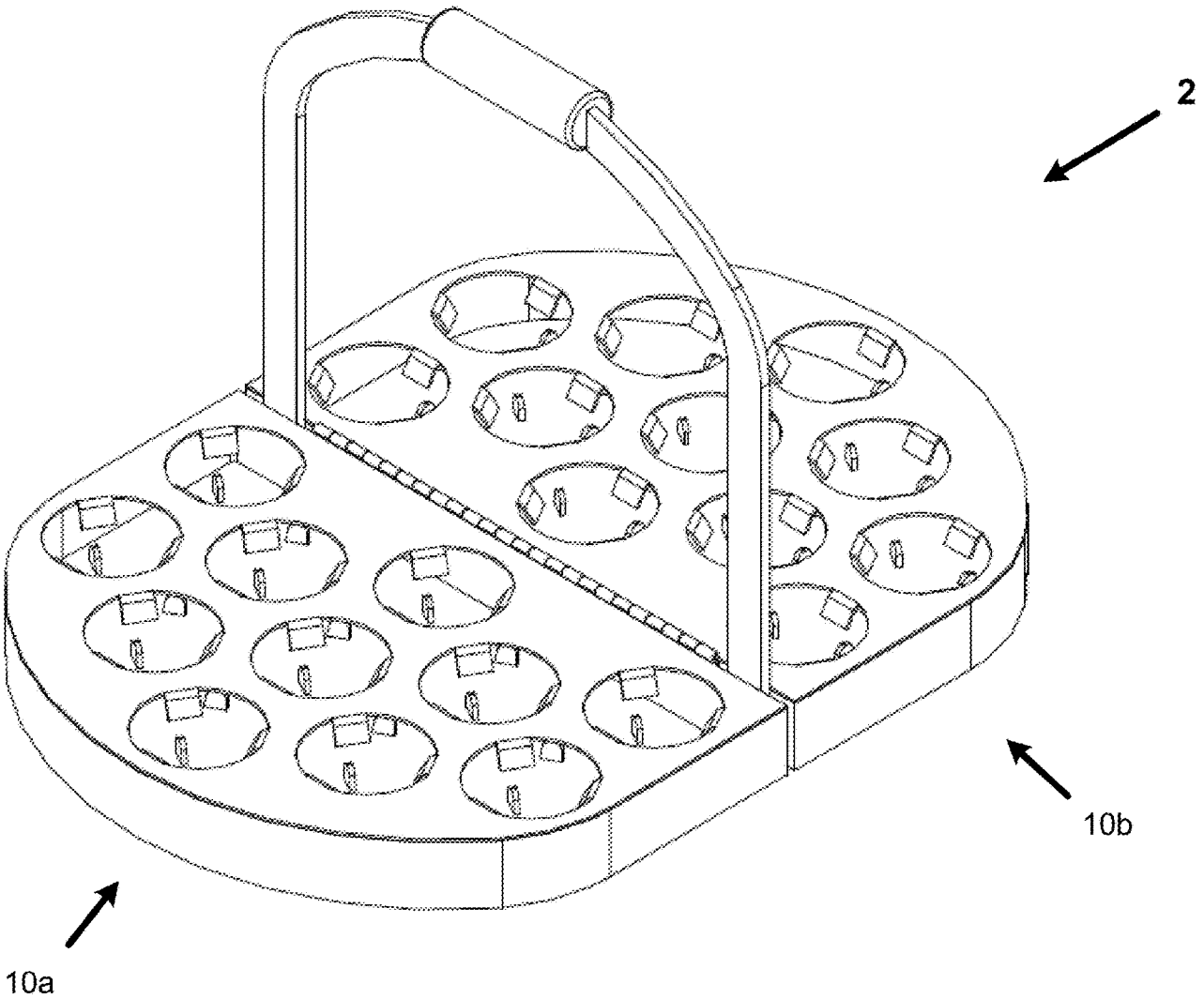
FIG. 2 is a perspective view of the carry tray of FIG. 1 with hole templates inserted.
Figure 5:
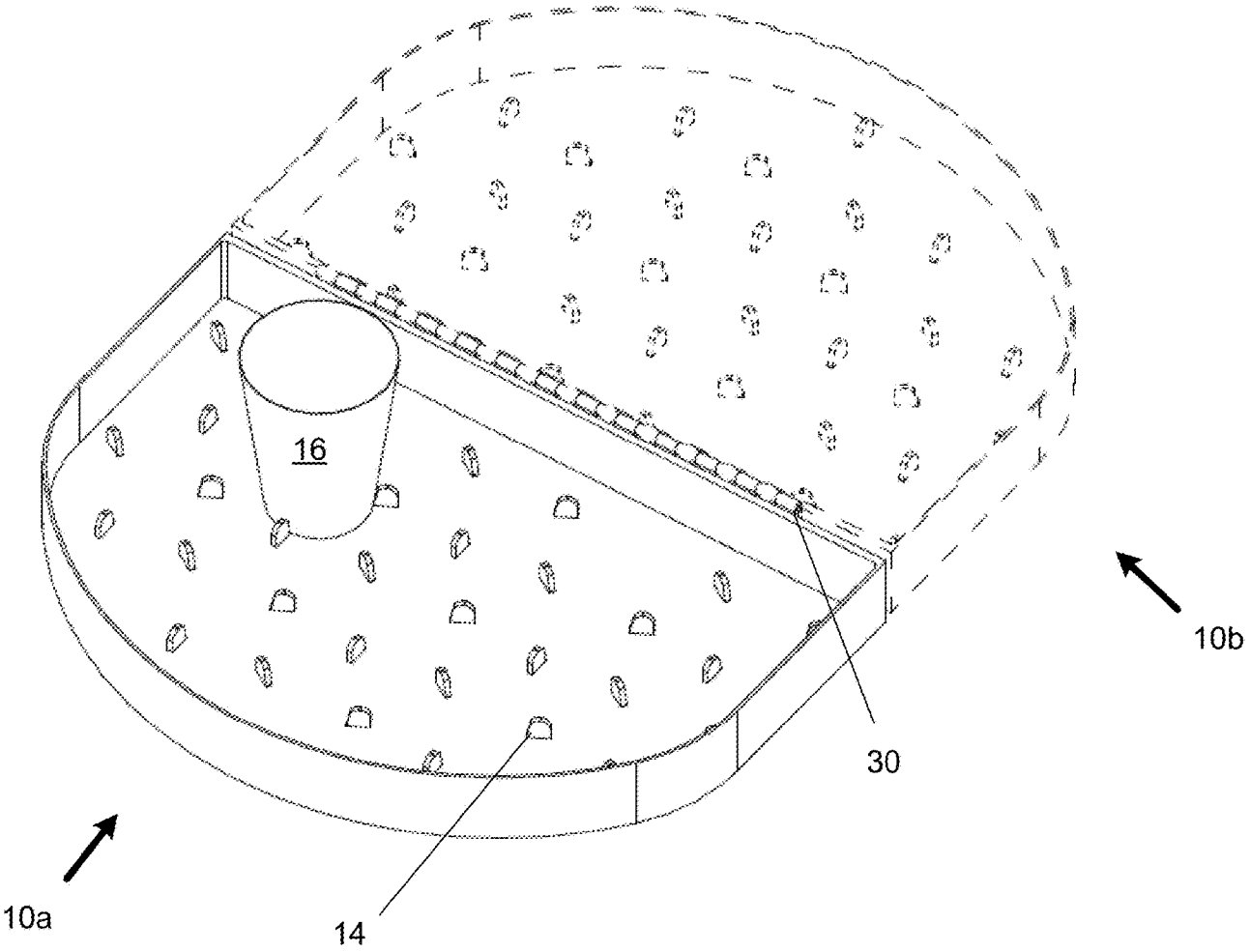
FIG. 5 is a perspective view of the base of the carry tray with alignment fins.
Figure 6:
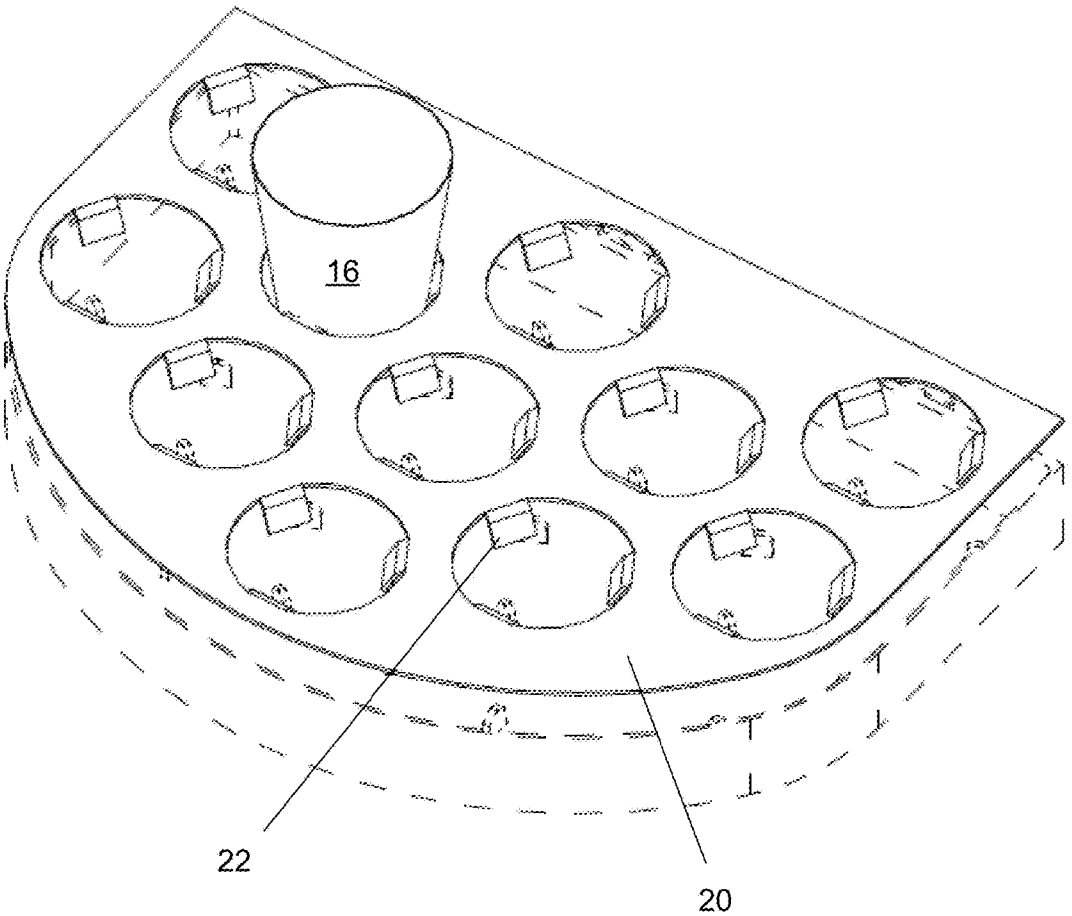
FIG. 6 is a perspective view of a hole template.
Figure 7:
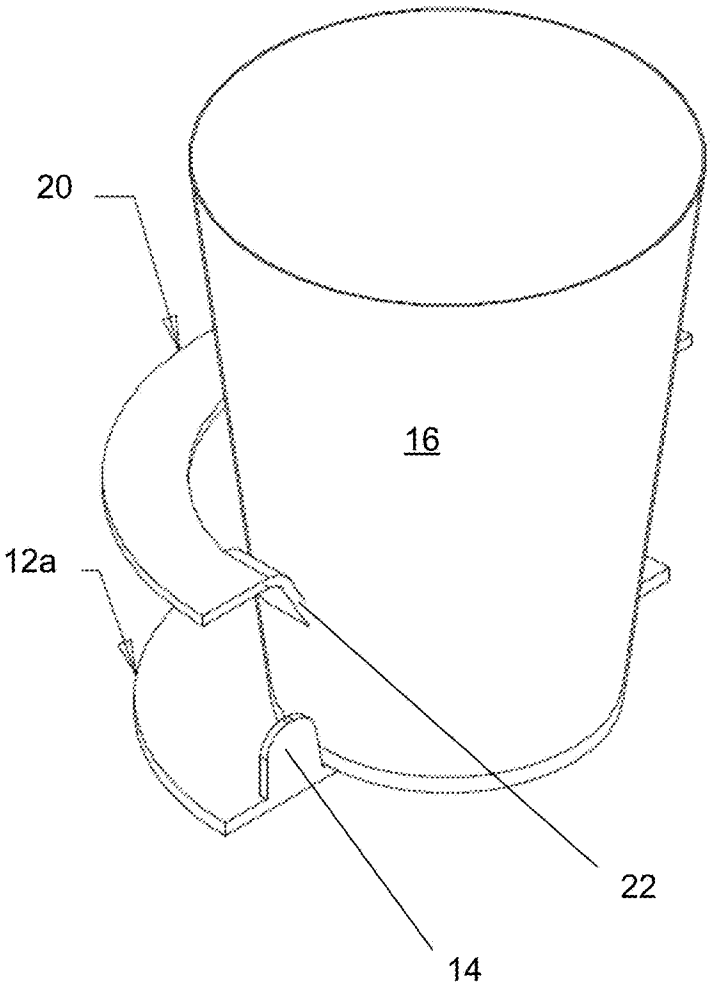
FIG. 7 is a cutaway view of a cup engaged by a hole template and alignment fins.

In one exemplary embodiment, as seen in FIGS. 1-2, one or both of the base parts comprise a plurality of alignment fins or tabs 14. The alignment fins are arranged or positioned to engage the bottom of a cup or bottle 16 and help secure or hold the cup or bottle in place. The fins may be tapered or rounded, to help receive and guide the bottom of the cup or bottle into place. While FIG. 5 shows three alignment fins engaging each cup or bottle, any number of fins can be used to engage each cup or bottle. In some embodiments, no alignment fins or tabs need be used, or alternative means to help secure the bottom of each cup or bottle may be used (such as indentations or recessed areas in the base).

One more hole templates 20 also may be used to help secure cups or bottles. Templates may be sized to match the corresponding base part, and may be removably secured thereto (i.e., snap-fit into the base part). Templates comprise one or more holes into which a cup or bottle is inserted. Holes may be positioned to align with corresponding sets of alignment fins or tabs 14. In one embodiment, flexible tabs 22 may extend at an angle inside each hole to engage the sides of the cup or bottle and help hold it upright therein.

Figure 3:
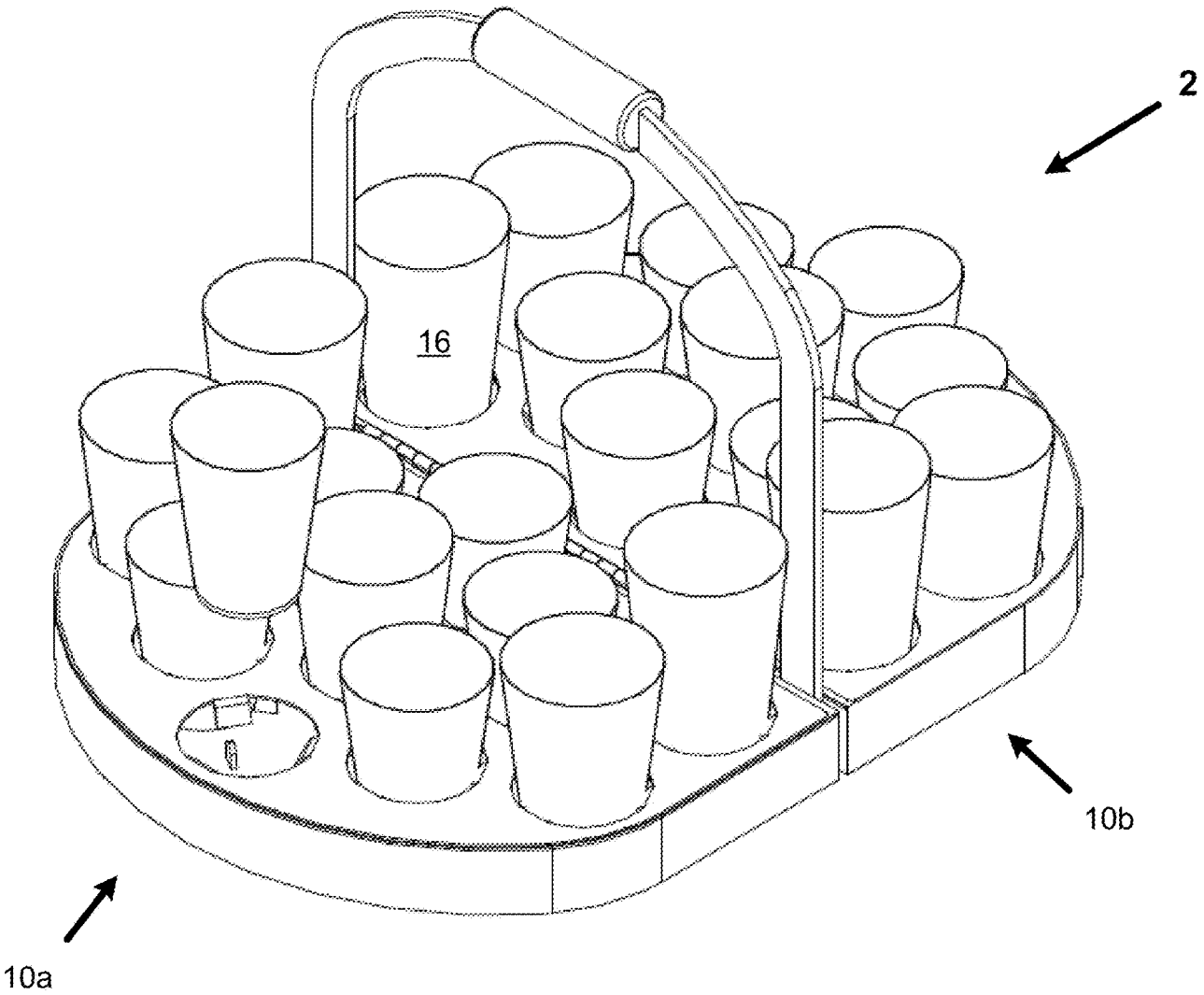
FIG. 3 is a perspective view of the carry tray of FIG. 2 with cups inserted.
Figure 4:
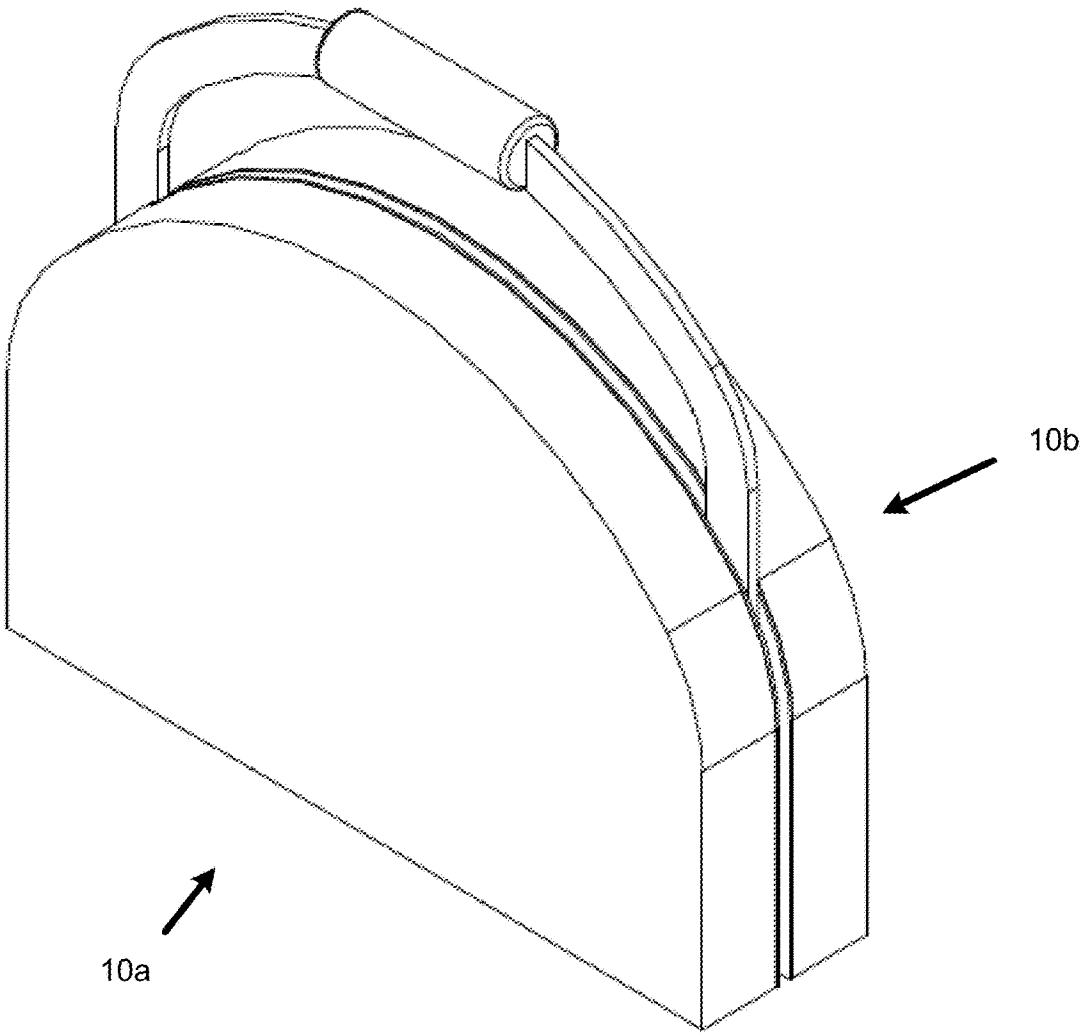
FIG. 4 is a perspective view of the carry tray of FIG. 1 in a closed position.

The carry tray can thus be used to carry drinks on both sides, as seen in FIG. 3. Alternatively, a hole template can be removed from one side, thereby allowing the carry tray to be used to carry drinks on one side, and other items (e.g., food, snacks, and the like) on the other side. Both hole templates also may be removed and carry tray used for food, snacks, and the like on both sides.

In another exemplary embodiment, as seen in FIGS. 13-16, foam inserts 40 may be used in place of hole templates (or as a form of hole template). The foam inserts 40 may be placed into corresponding base parts, and are held in place due to friction or pressure with the sides of the base part, tabs or flanges along the edge of the base part, hook-and-loop fasteners, or combinations thereof. The holes 42 in the foam insert may taper downwards in diameter, or may otherwise vary in inner diameter within a single hole. The foam insert may extend for some or all of the depth of the base part, thereby allowing the hole in the foam to securely hold the cup or container placed in the hole. The foam insert may be used without or with alignment fins or tabs, as described above.

For hole templates or foam inserts, the holes in a particular template or insert may vary in size, or some or all may have the same dimensions. In several embodiment, the uppermost edge of the hole may be beveled 44, to assist in the insertion of a cup or bottle. Thus, a given template or insert may be used to hold different sized cups or bottles. In one embodiment, a template or insert may have holes only in part of the template or insert, allowing the other portions of the insert to be used to carry food, snacks, and the like on that side. The template or foam insert may be provided with an box or indentation or other impression for this purpose. The same effect may be achieved with the template or insert only partially covering the base, or it respective part of the base.

Figure 8:
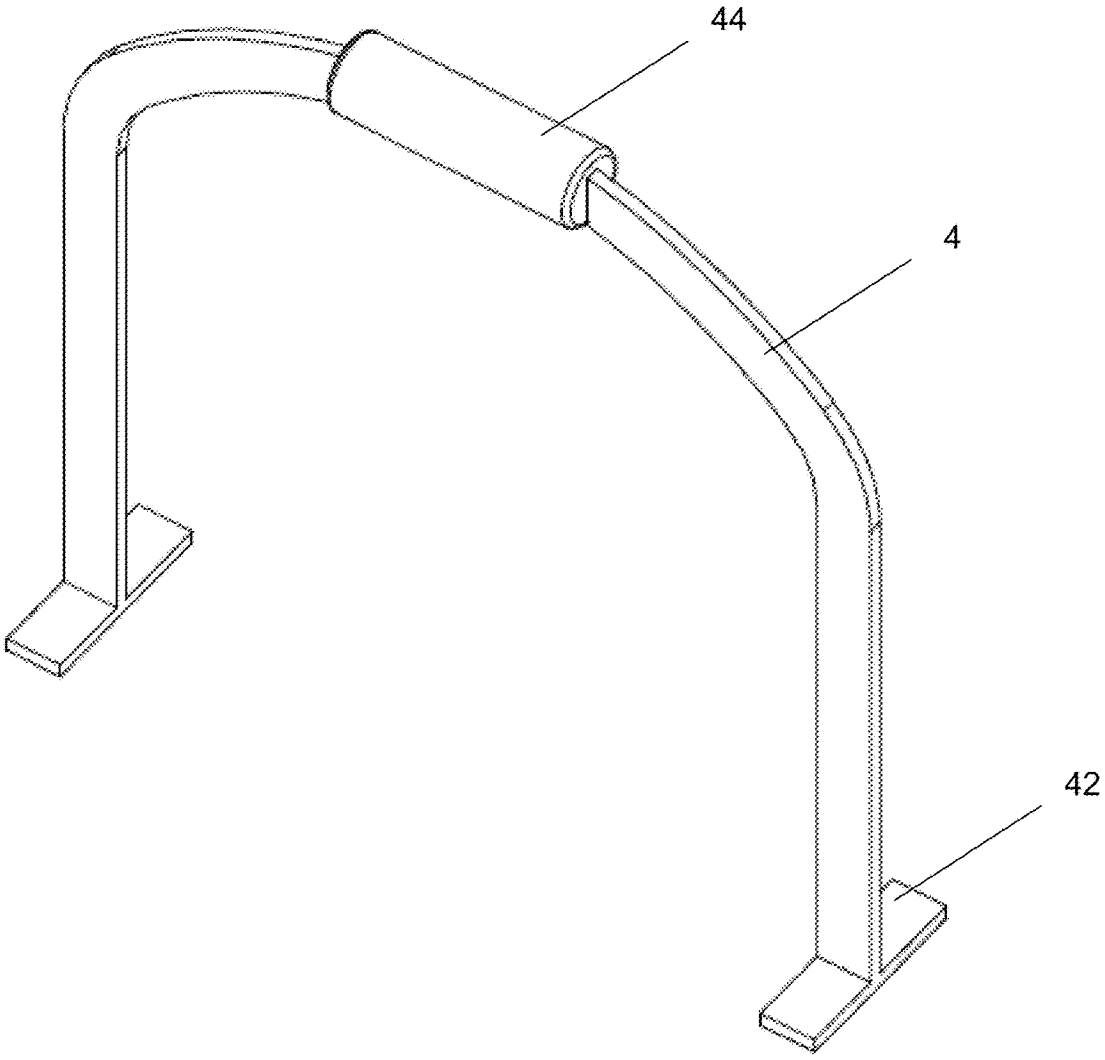
FIG. 8 is a perspective view of a handle.
Figure 9:
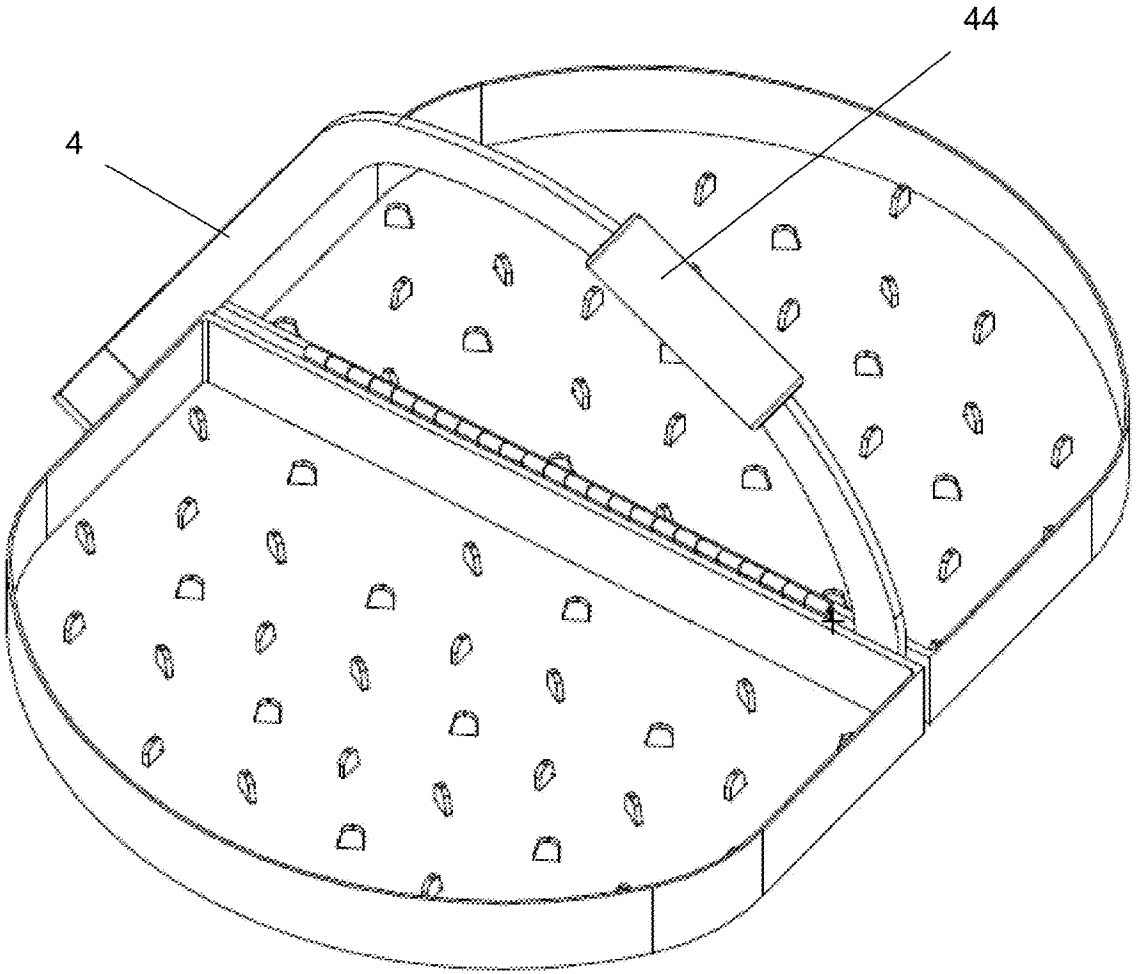
FIG. 9 is a perspective view of a carry tray with a handle in the process of removal.
Figure 10:
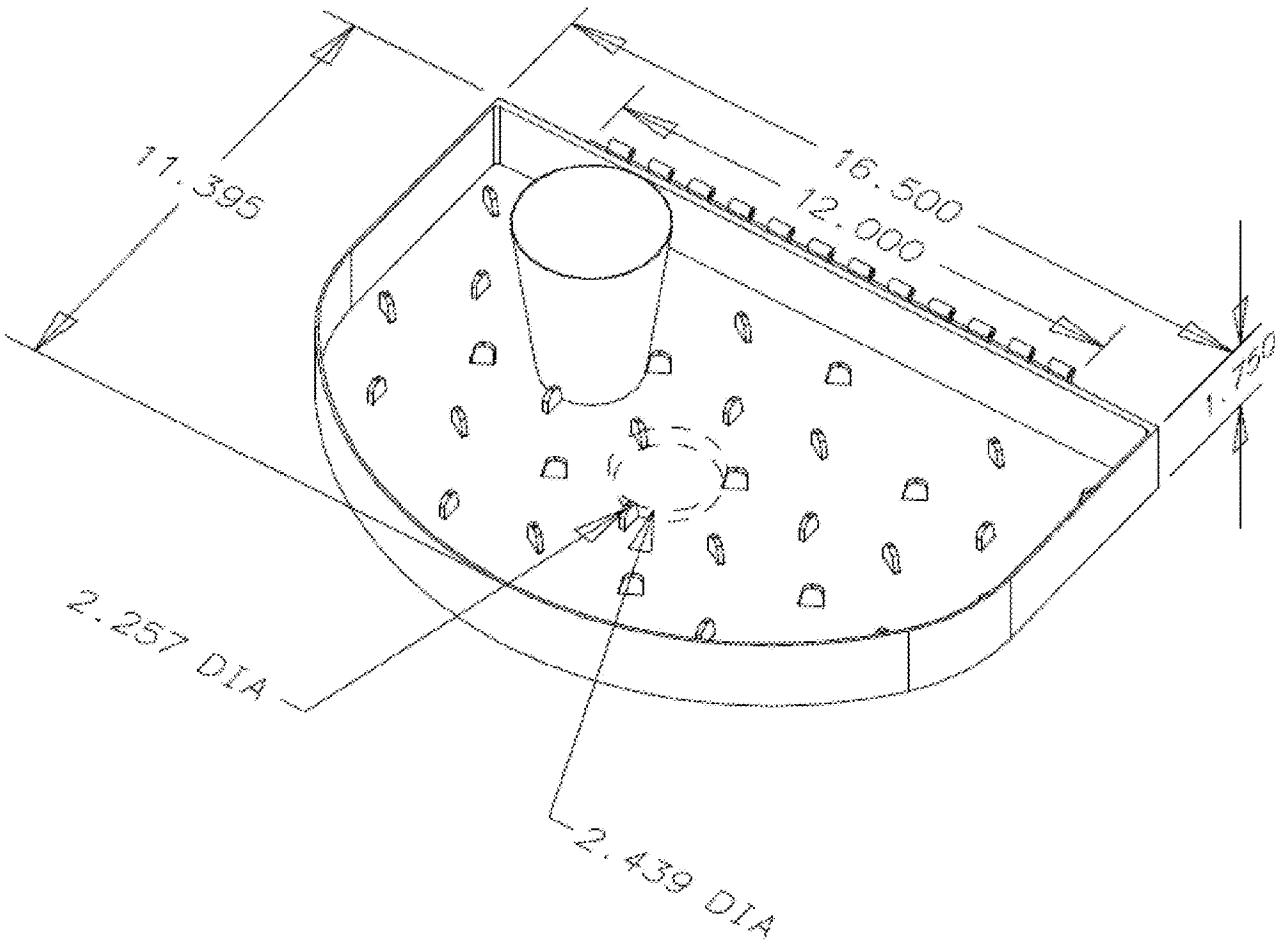
FIG. 10 is another view of the base of the carry tray with alignment fins.
Figure 11:
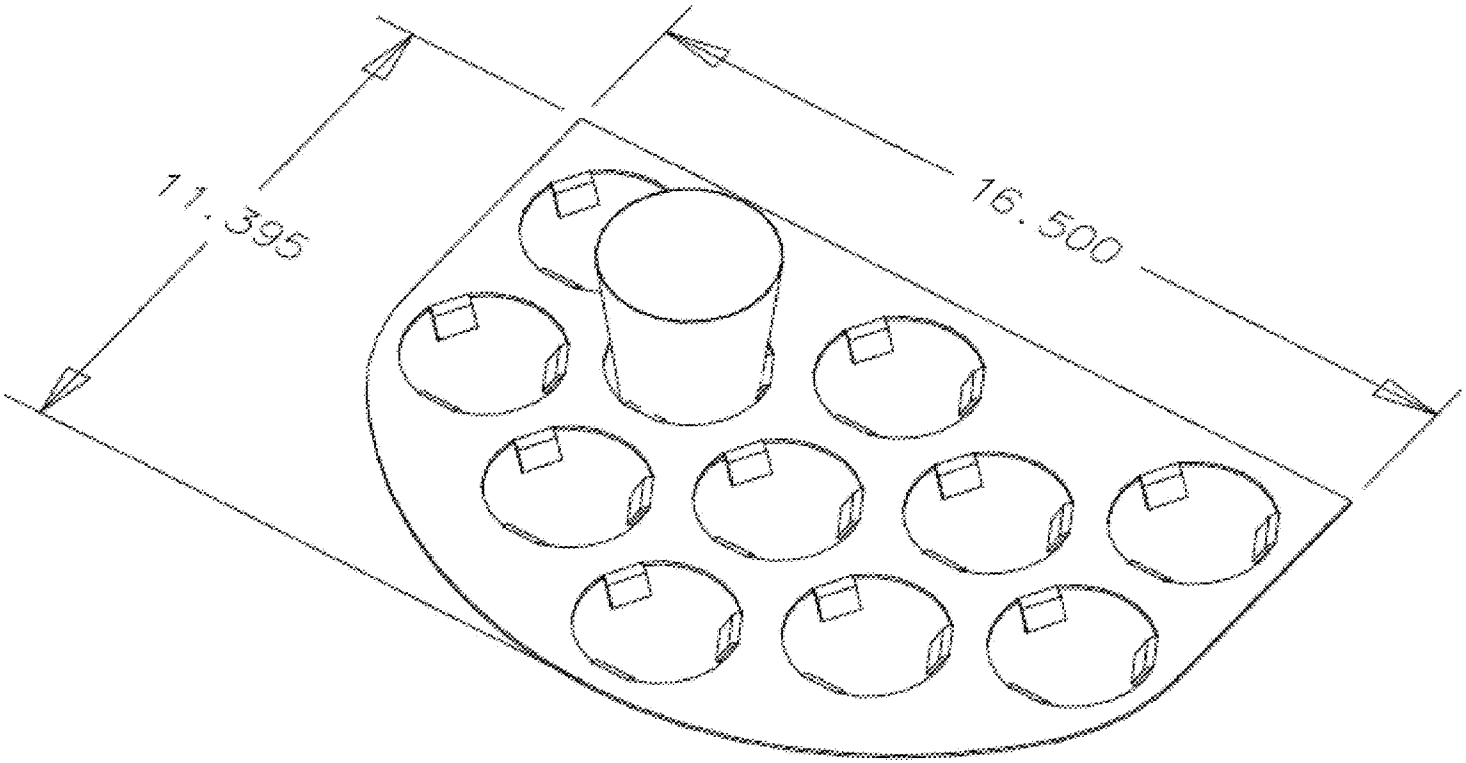
FIG. 11 is another view of a hole template.
Figure 12:
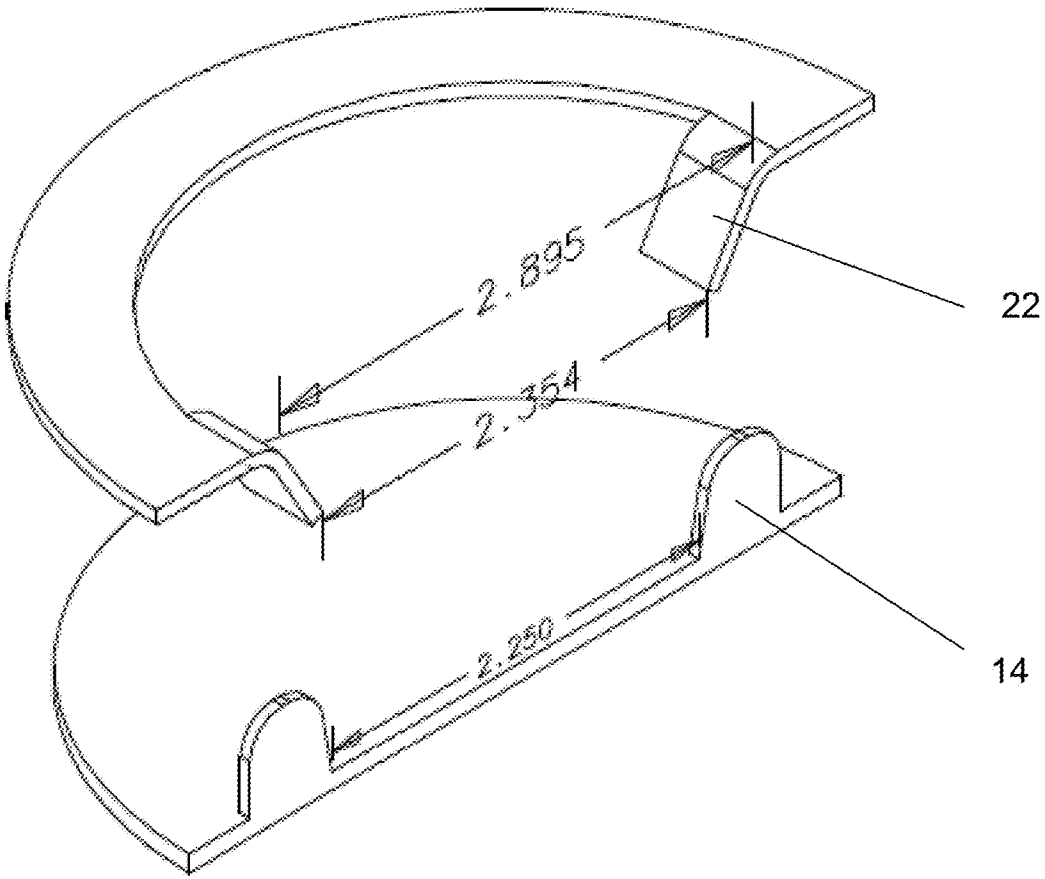
FIG. 12 is another cutaway view of the hole section of a hole template in relation to alignment fins on the base.
Figure 13:
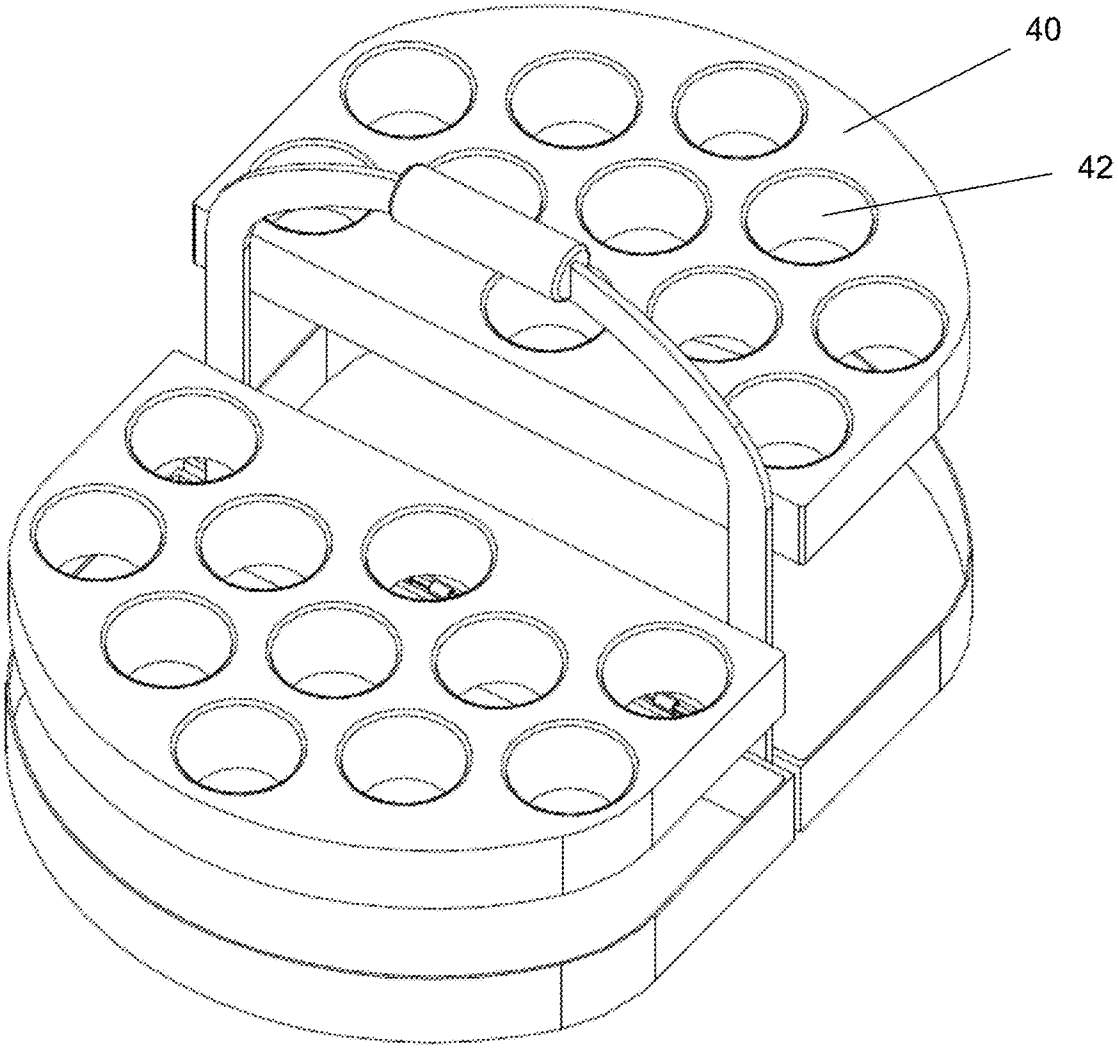
FIG. 13 is a perspective view of a carry tray with foam inserts.
Figure 14:
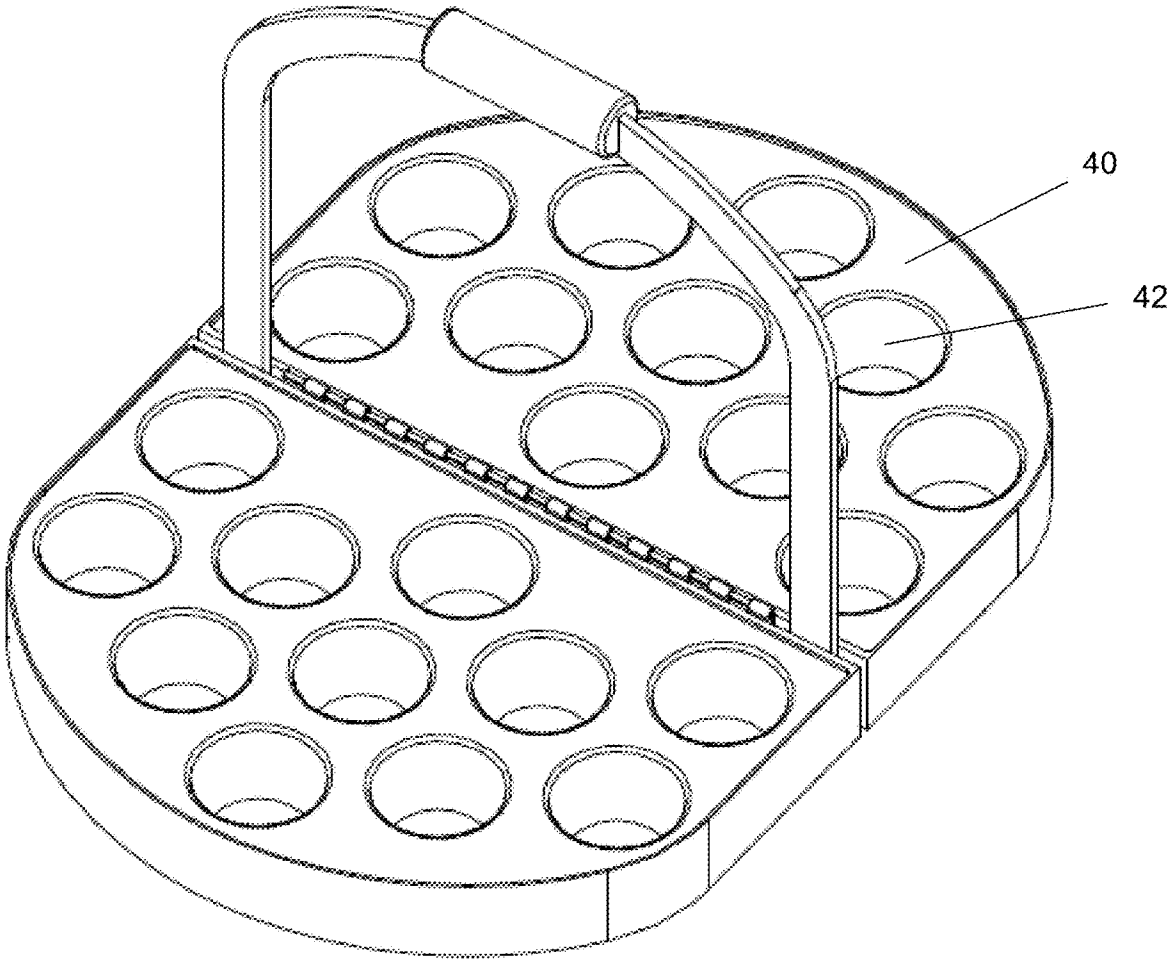
FIG. 14 is a perspective view of the carry tray of FIG. 13 with foam inserts in place.
Figure 15:
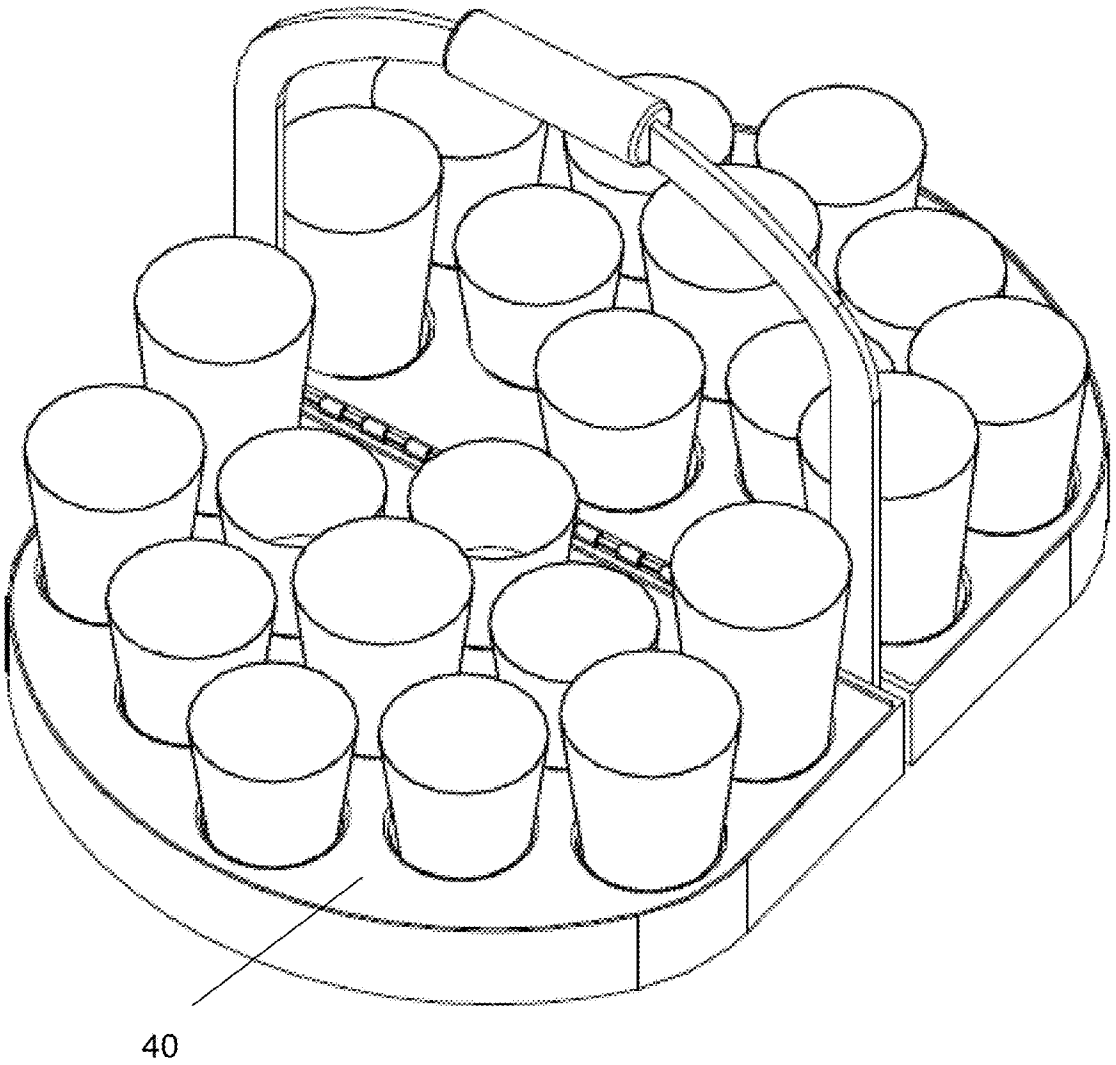
FIG. 15 is a perspective view of the carry tray of FIG. 14 with cups inserted.
Figure 16:
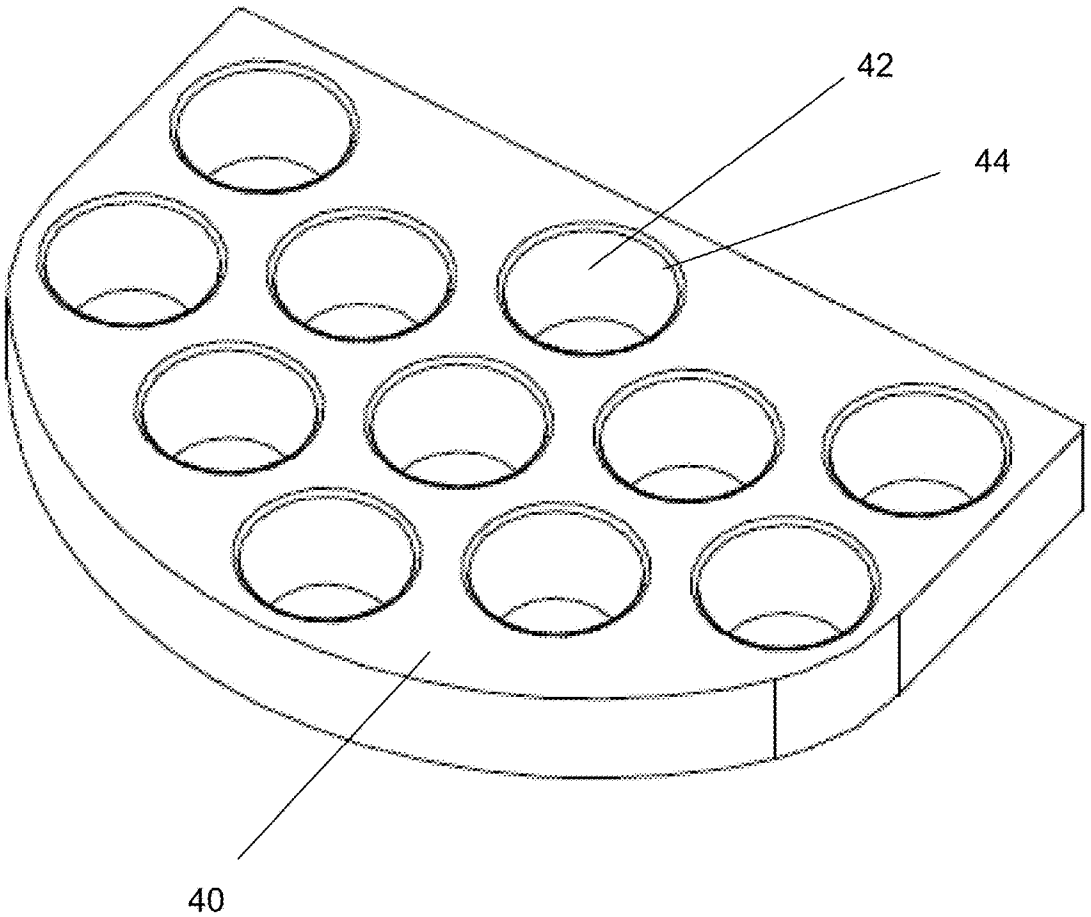
FIG. 16 is a perspective view of a foam insert.

The handle can be of any suitable size or configuration. In one embodiment, as seen in FIGS. 8-9, the handle 4 is molded from ridged material, and comprises a T-shape 42 at each end to engage the base parts and help lock the carry tray together. A contoured or cushioned grip 44 may be located at the top center of the handle. The handle can be rotated to the side for removal or assembly, as seen in FIG. 9. The carry tray can be used with or without the handle.

Figure 17:
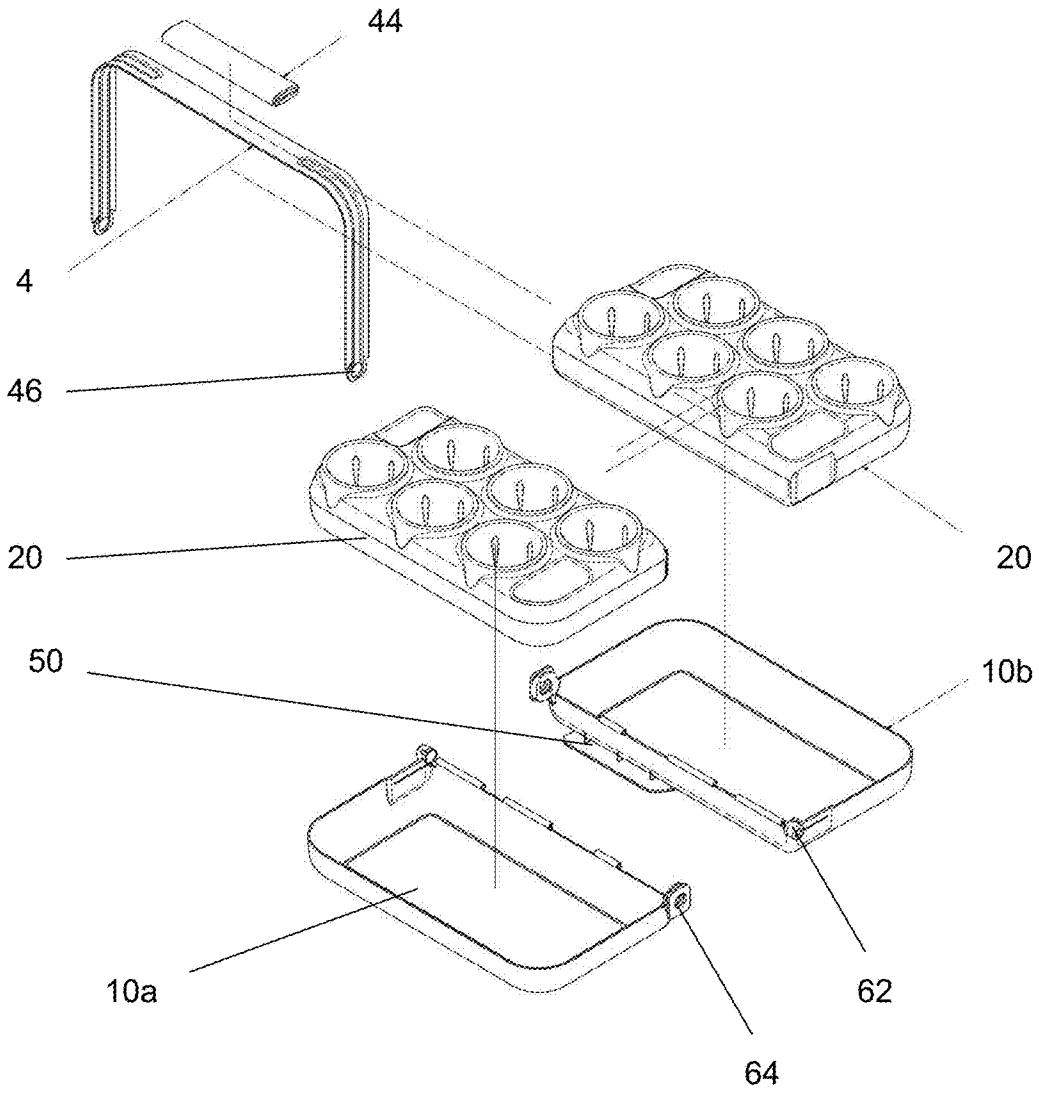
FIG. 17 is an exploded view of an exemplary embodiment of the carry tray.
Figure 18:
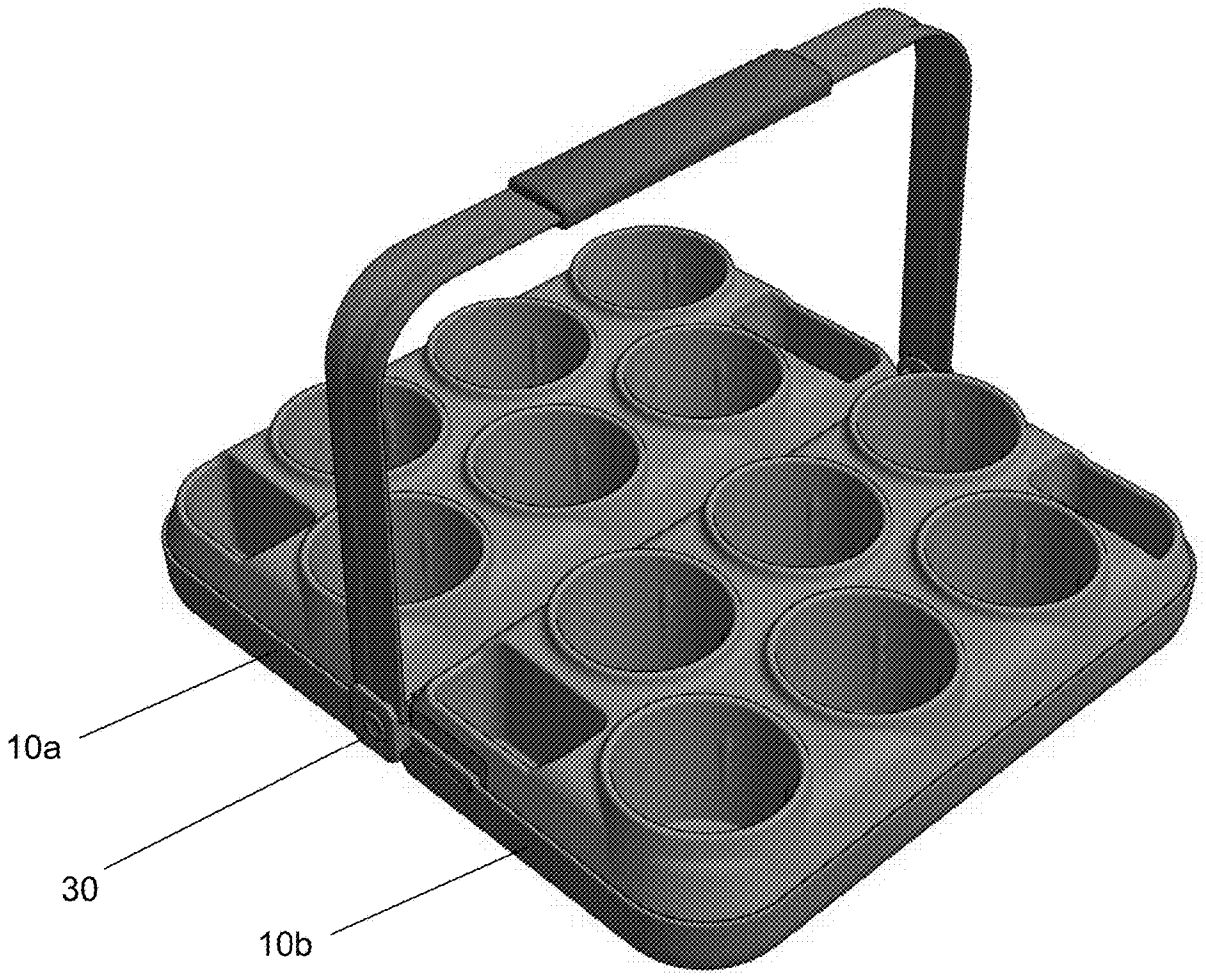
FIG. 18 is a perspective view of the carry tray of FIG. 17 in an open position.
Figure 19:
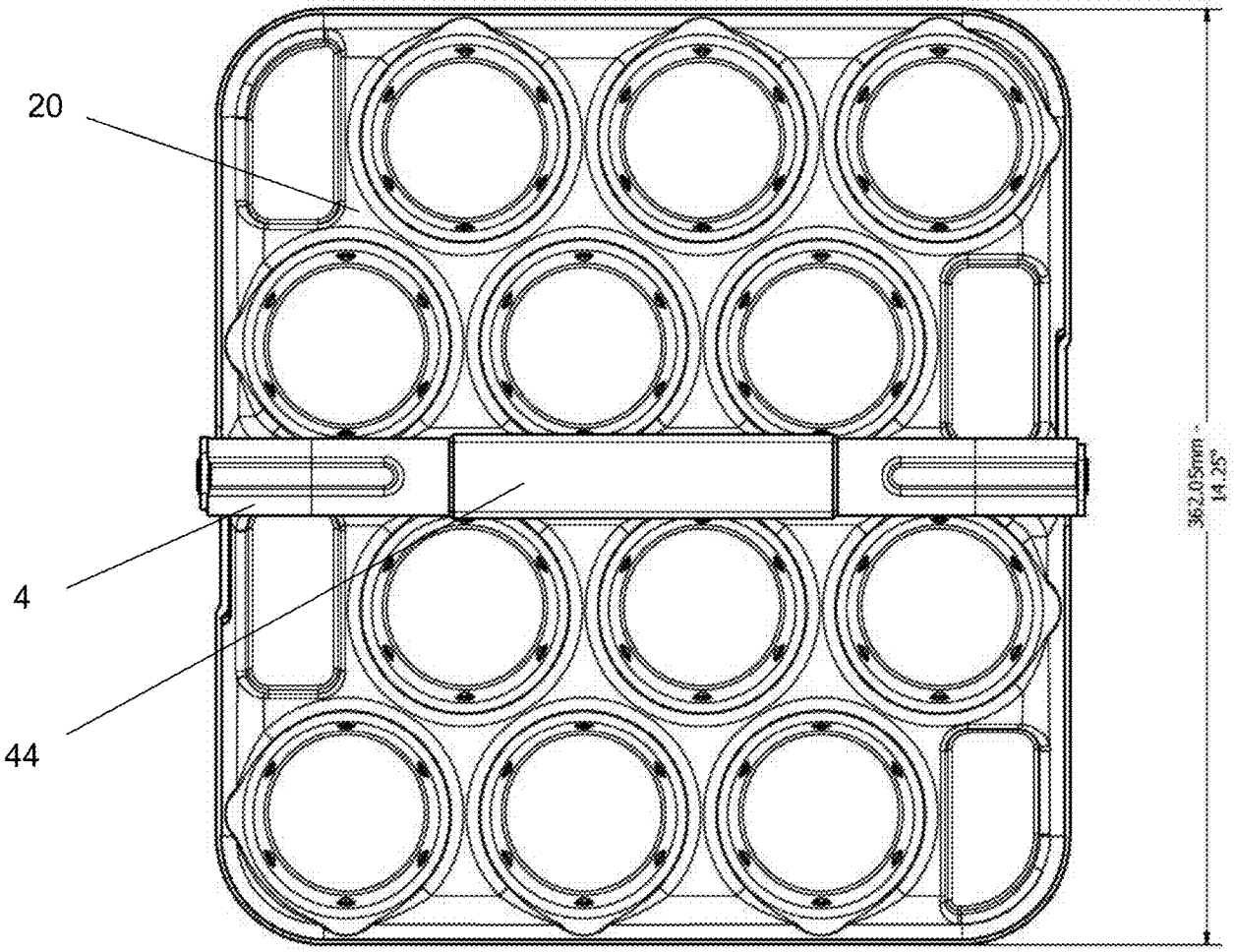
FIG. 19 is a top view of the carry tray of FIG. 18.
Figure 20:
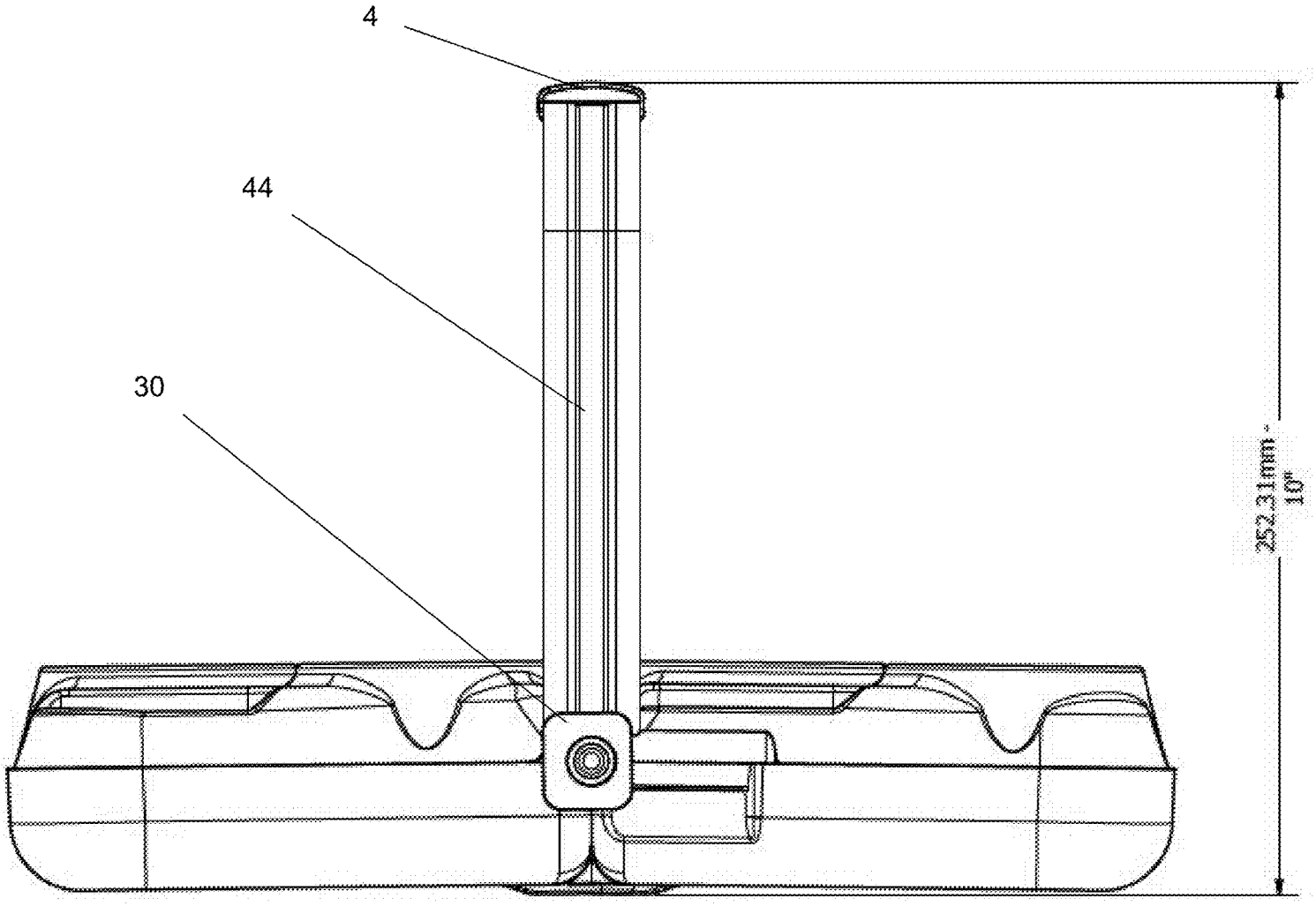
FIG. 20 is a side view of the carry tray of FIG. 18.
Figure 21:
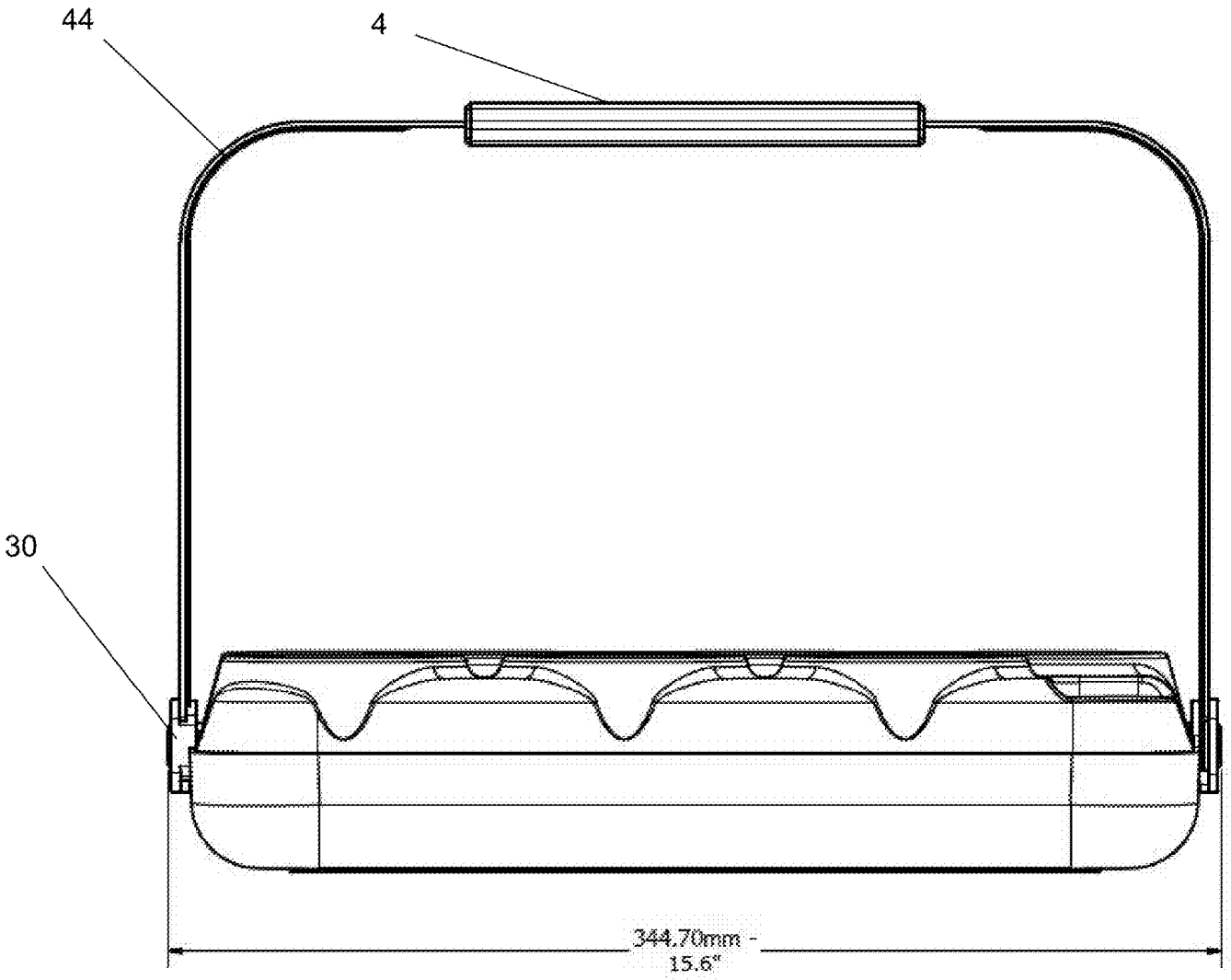
FIG. 21 is an end view of the carry tray of FIG. 18.
Figure 22:
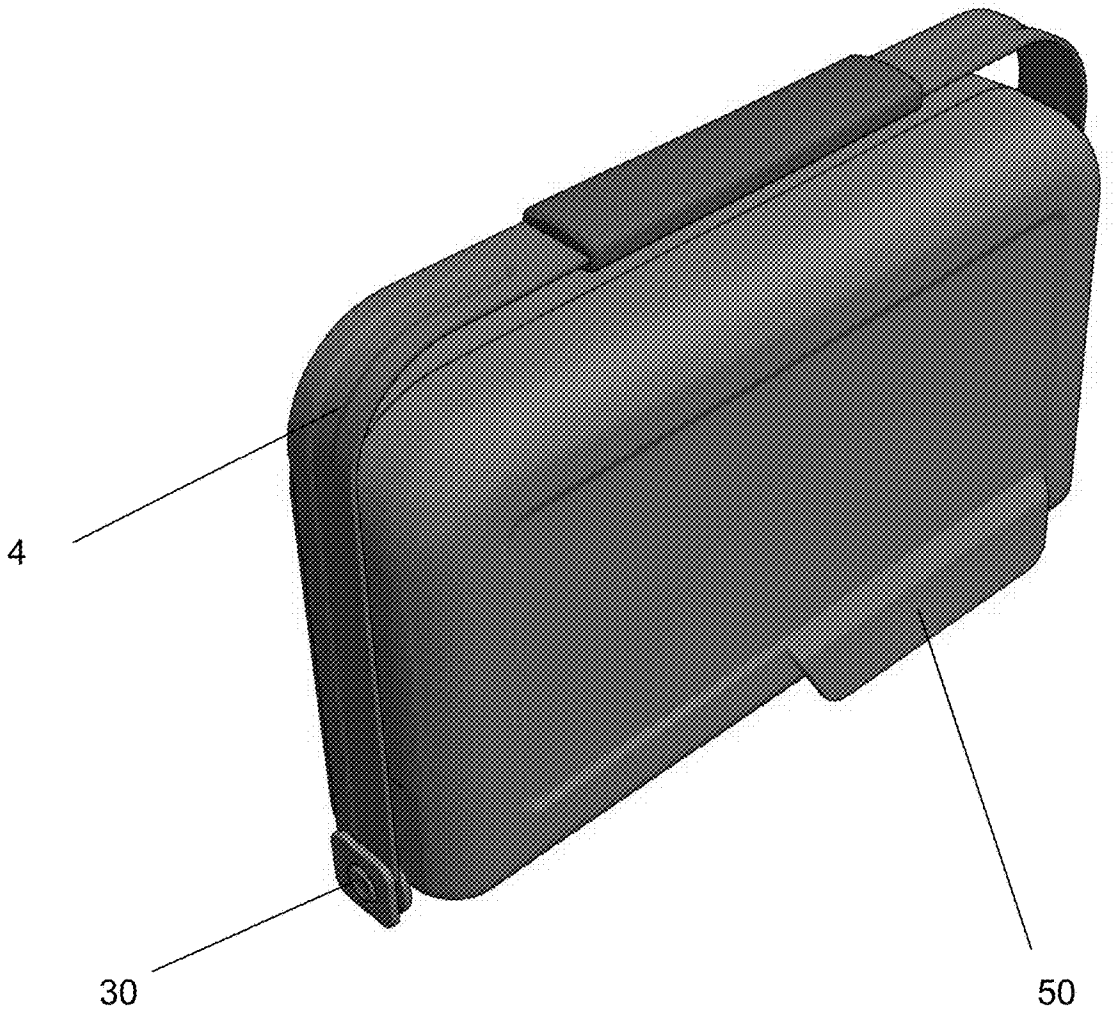
FIG. 22 is a perspective view of the carry tray of FIG. 17 in a closed position.
Figure 23:
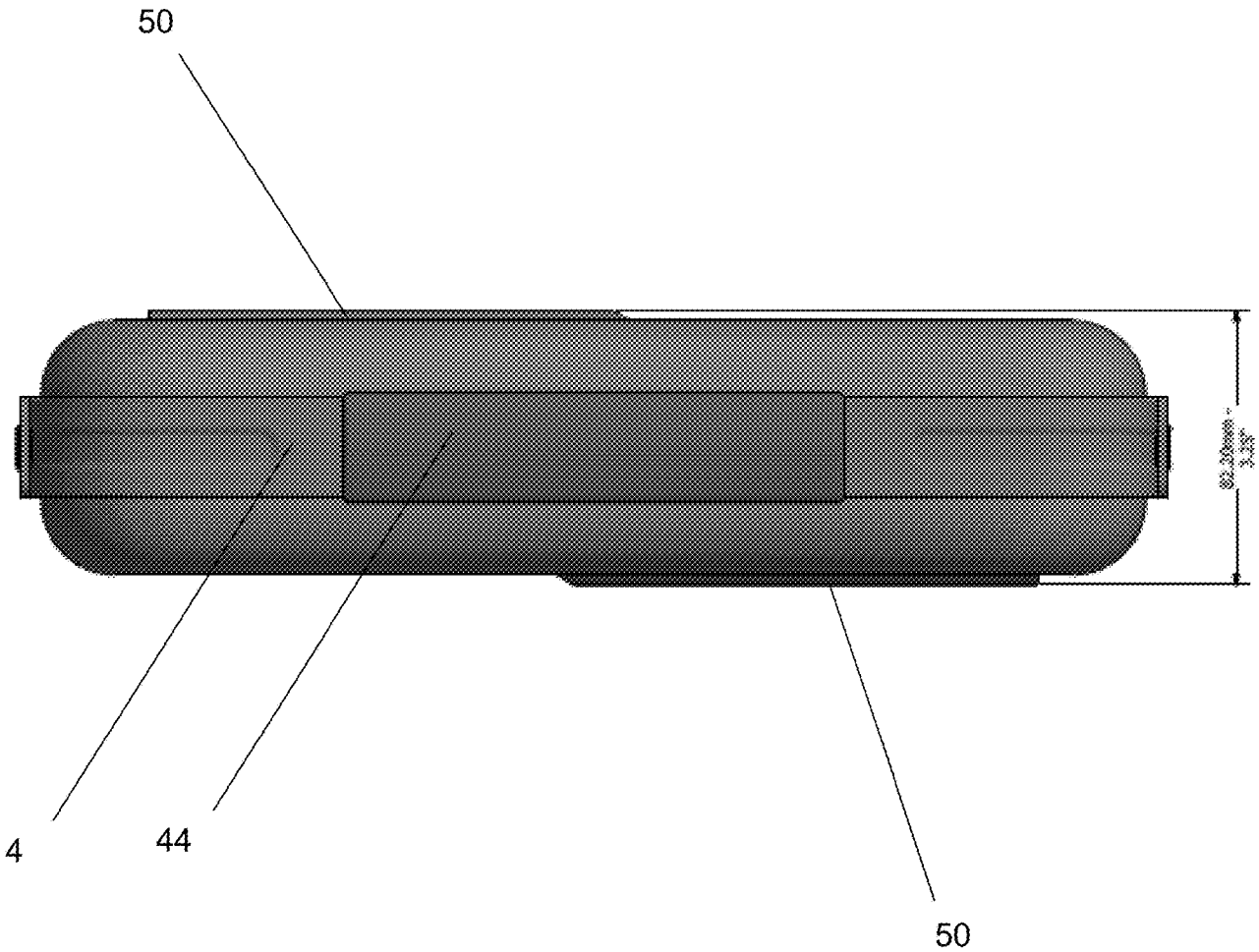
FIG. 23 is a top view of the carry tray of FIG. 18.
Figure 24:
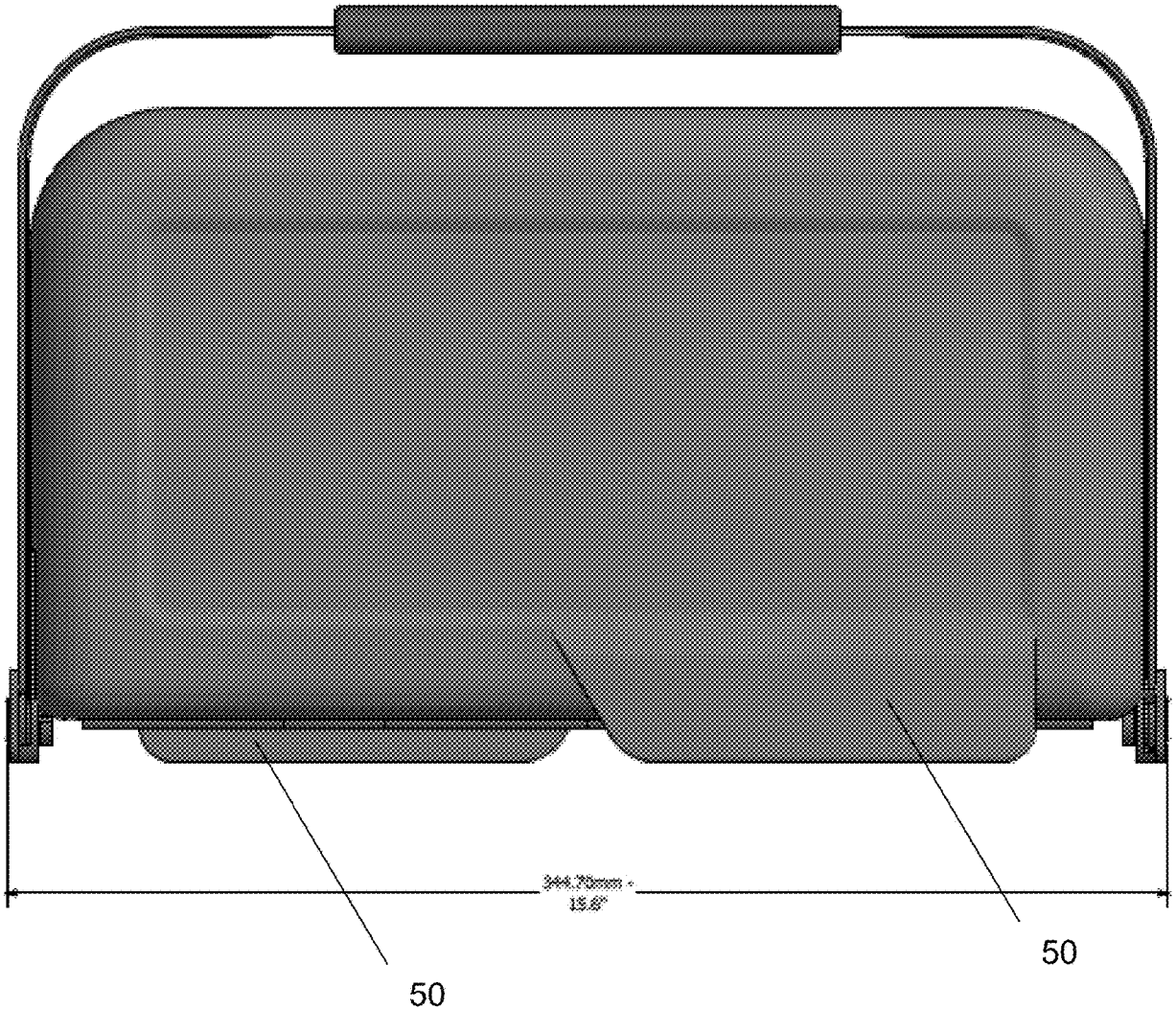
FIG. 24 is a side view of the carry tray of FIG. 18.
Figure 25:
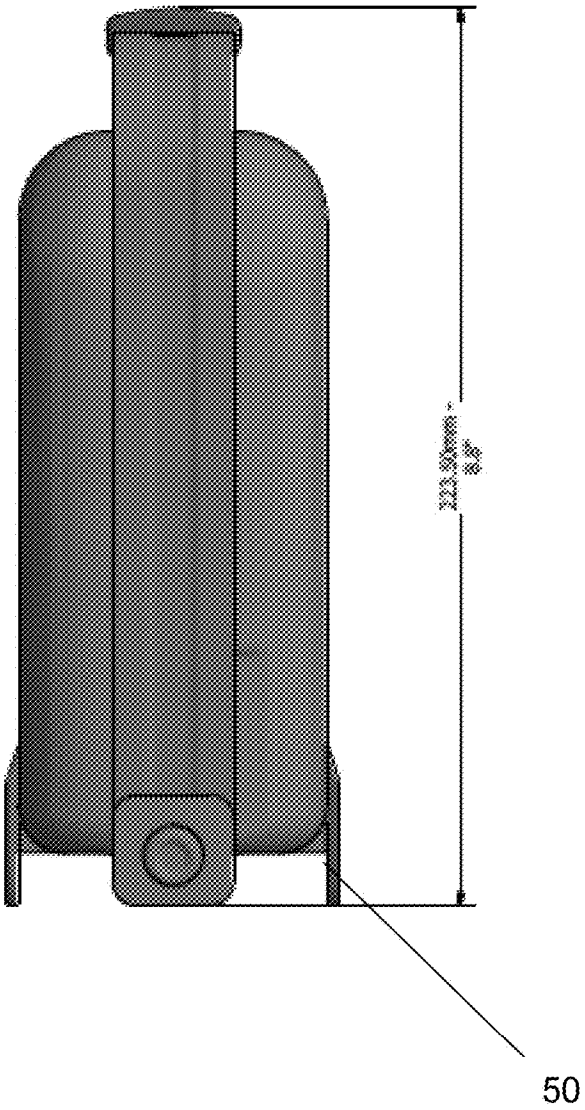
FIG. 25 is an end view of the carry tray of FIG. 18.

FIG. 17 shows an exploded view of an embodiment of the carry tray, with two-part base 10*a, b* hingedly attached 30, two hole templates (which may be foam) 20 that fit into the base components, and a handle 4 with contoured or cushioned grip 44, where the ends of the handle comprise a circular opening 46, which also may assist as part of a locking mechanism. FIGS. 18-21 shows the embodiment of FIG. 17 in an assembled, open configuration, while FIGS. 22-25 show it in a closed configuration. It should be noted that in this embodiment, each part of the base housing comprises a flange 50 extending from at least a portion of the bottom edge adjacent the other base housing part. In the embodiment shown, each part has a flange extending partway over no more than one half of the same respective portion of the bottom edge, so that the flanges each extend under the other base part where there is no flange when the carrier is opened (i.e., the flanges do not interfere with each other). The flanges thus can serve as supports to help hold the carrier in an upright position on this edge when in a closed position, and can help support the adjacent base part (and prevent the carrier from opening too far at an oblique angle) when in an open position. This construction also allows each base part to be identical in structure, increasing manufacturing efficiency and lowering manufacturing and inventory costs.

Figure 26:
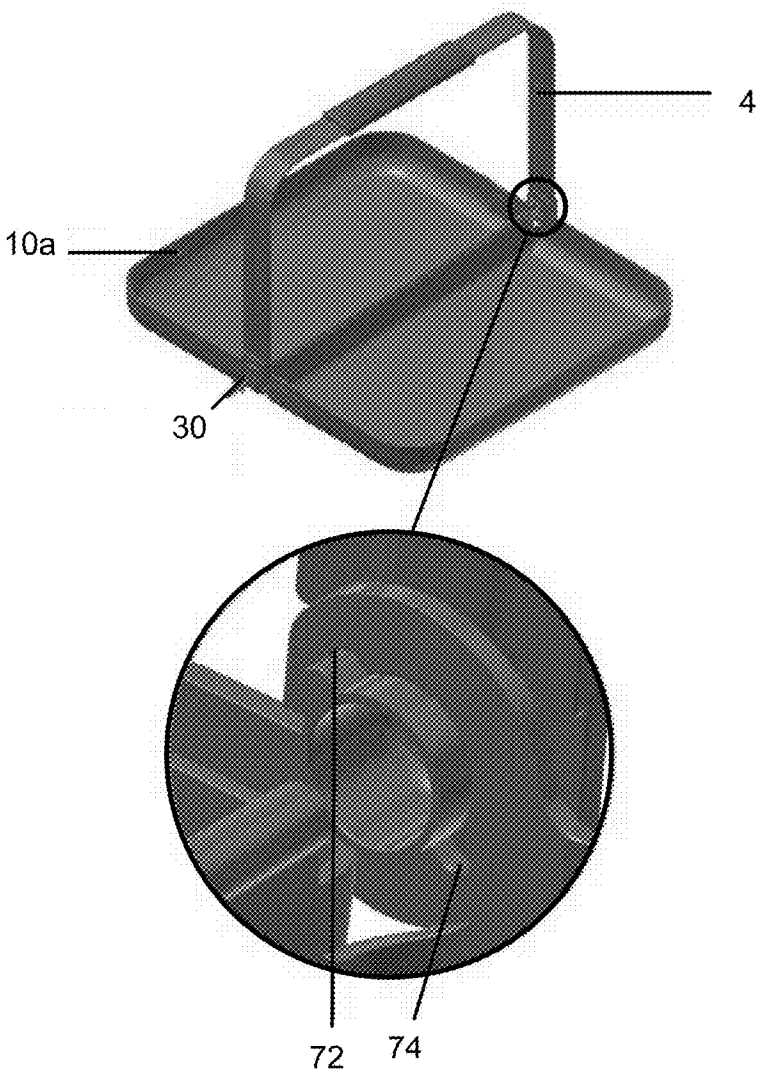
FIG. 26 shows a close-up view of the push-button locking mechanism for a hinge.
Figure 27:
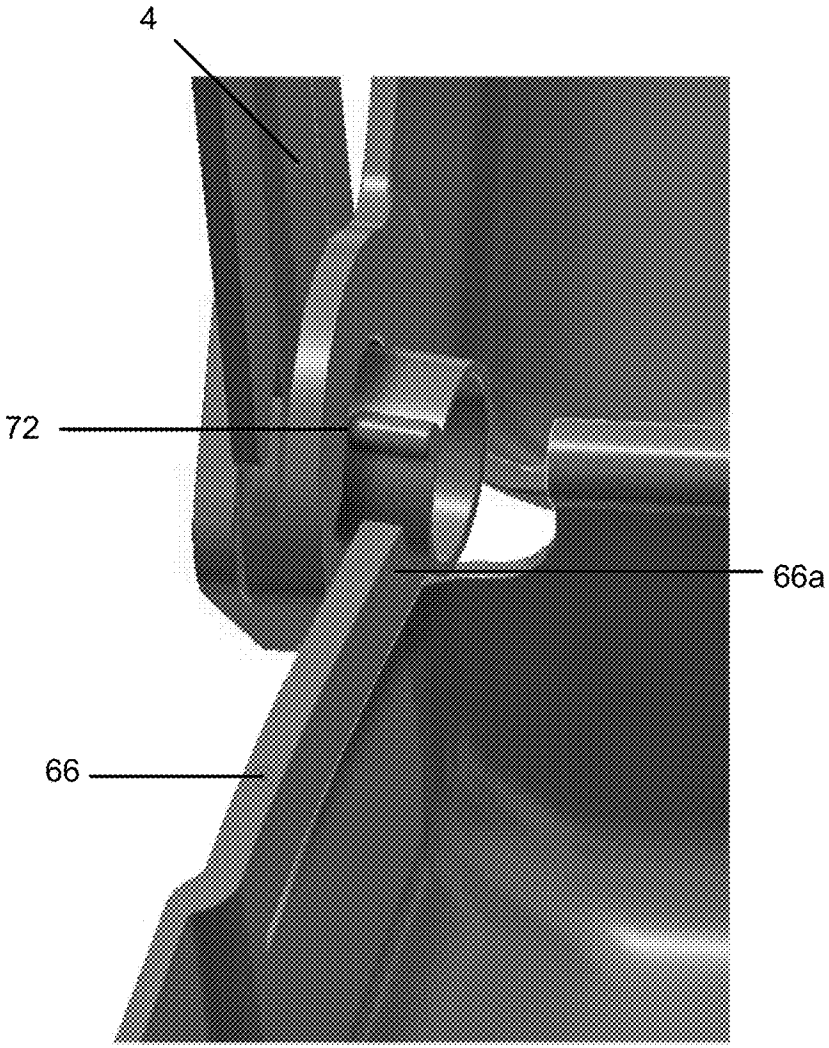
FIG. 27 shows a close-up view of the locking mechanism of FIG. 26 with the push button being pushed in to an unlocked position.

As seen in FIGS. 26-27, in one exemplary embodiment the present invention comprises a push-button locking mechanism for the hinges. In the embodiment shown, each hinge push-button lock comprises a push-button male component 62 with a tab on a corner of one base part that is inserted into a corresponding female component 64 on a corresponding corner of the second base part. The components may be inserted and connected in a snap-fit arrangement. Pushing the push-button in allows the hinge to rotate from a closed locking position to an open locking position (i.e., the hinge is locked both when closed and when fully opened), set by positions of notches on the inside circumference of the female components, which receive and hold the tab on the male component. The ends of the handle may be integrated into the hinge, so that the handle can swivel and rotate when the hinge is in a closed locked position, but the handle is locked in an upright position (i.e., approximately 90 degrees with respect to the plane formed by the base components) when the hinge is in an open locked position.

In one embodiment, the male component is positioned at the end of a partially flexible strip 66 along the top edge of the base. This strip is biased (i.e., has a natural spring-like effect) so the tab 72 on the male push-button component slides into the corresponding notches 74 on the female component to hold the hinge in the locked positions. Pushing the button in flexes the end of the strip 66*a* sufficiently so the tab disengages a notch in which it is locked, and allows the components to be rotated, respectively. When in use, the inserts in the interior of the base components provide support and help prevent the strip from being pushed too far inward to bend or break.

The dimensions of the carry tray can vary as needed to meet the needs of different venues. In one embodiment, each base part is approximately 16.5 inches long (along the hinged side), approximately 11.395 inches wide, and approximately 1.75 inches deep. The template is sized to match. Each set of alignment fins 14 is spaced to accommodate a circle of approximately 2.257 inches in diameter, while the hole tabs 22 are sized to accommodate a circle of approximately 2.354 inches in diameter at their narrowest point. These dimensions are suited to engage most standard size cups used in sporting and similar venues in the United States. In this configuration, the carry tray can carry up to 11 hot or cold beverages on either side (22 total). The central, stationary handle (when in place) allows the user to do so with one hand, thereby allowing a user to safely and efficiently carry a variety of drinks and other items from a vendor or other place of purchase to another location (e.g., seats, box, or the like) for consumption.

The carry tray can be made of any suitable material. In one embodiment, the carry tray is made of plastic, in whole or in part, and is washable and reusable.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A carry tray, comprising:

a first base component hingedly attached to a second base component at two lockable hinge joints positioned at adjacent corners on said first base component and said second base component;

a first hole template removably inserted into the first base component;

a second hole template removably inserted into the second base component; and a rotatable handle;

wherein the hole templates each comprise a plurality of circular holes, said circular holes further comprising a plurality of flexible tabs extending inward.

2. The carry tray of claim 1, wherein the handle is removable.

3. The carry tray of claim 1, wherein the hole templates are independently removable.

4. The carry tray of claim 1, wherein the hole templates each comprise a plurality of circular holes.

5. The carry tray of claim 1, wherein the hole templates are foam.

6. The carry tray of claim 5, wherein the holes in the foam template extend entirely therethrough.

7. A carry tray, comprising:

a first base component hingedly attached to a second base component at two lockable hinge joints positioned at adjacent corners on said first base component and said second base component;

a first hole template removably inserted into the first base component;

a second hole template removably inserted into the second base component; and a rotatable handle;

wherein each lockable hinge joint comprises a male push-button component on a first corner of the first base component, and a female component on a second corner of the second base component.

8. The carry tray of claim 1, wherein each lockable hinge joint comprises a closed locking position and an open locking position.

9. A carry tray, comprising:

a first base component hingedly attached to a second base component at two lockable hinge joints positioned at adjacent corners on said first base component and said second base component;

a first hole template removably inserted into the first base component;

a second hole template removably inserted into the second base component; and a rotatable handle;

wherein each lockable hinge joint comprises a closed locking position and an open locking position; and further wherein the handle has two ends, and each end is rotatably connected to a corresponding lockable hinge joint.

10. The carry tray of claim 9, wherein the handle is rotatable when the lockable hinge joints are in a closed locked position, and the handle is locked in a fixed upright position when the lockable hinge joints are in an open locked position.

11. The carry tray of claim 9, each base component further comprising a partial flange extending from a bottom edge.

* * * * *